US010668637B1

(12) United States Patent
Stone, Jr.

(10) Patent No.: US 10,668,637 B1
(45) Date of Patent: Jun. 2, 2020

(54) CRANIAL SHAVING DEVICE

(71) Applicant: Jeffrey C. Stone, Canton, OH (US)

(72) Inventor: Jeffery C. Stone, Jr., North Canton, OH (US)

( * ) Notice: Subject to any disclaimer, the term of this patent is extended or adjusted under 35 U.S.C. 154(b) by 0 days.

(21) Appl. No.: 15/629,788

(22) Filed: Jun. 22, 2017

Related U.S. Application Data

(60) Provisional application No. 62/352,766, filed on Jun. 21, 2016.

(51) Int. Cl.
*B26B 21/52* (2006.01)
*B26B 21/22* (2006.01)

(52) U.S. Cl.
CPC ..... *B26B 21/522* (2013.01); *B26B 21/225* (2013.01); *B26B 21/521* (2013.01)

(58) Field of Classification Search
CPC ... B26B 21/522; B26B 21/225; B26B 21/521; B26B 21/00; B26B 21/52; B26B 21/523
USPC ..... 30/526, 32
See application file for complete search history.

(56) References Cited

U.S. PATENT DOCUMENTS 4,208,791 A * 6/1980 Van Cleve ..... B26B 21/18 30/346.58
4,754,548 A * 7/1988 Solow ..... B26B 21/4006 30/32
4,976,028 A * 12/1990 Chen ..... B26B 21/4012 30/49
5,031,319 A * 7/1991 Althaus ..... B26B 21/522 30/526
5,199,173 A * 4/1993 Hegemann ..... B26B 21/165 30/49
D378,147 S * 2/1997 Hegemann ..... D28/46
5,979,056 A * 11/1999 Andrews ..... B26B 21/00 30/356
7,086,160 B2 * 8/2006 Coffin ..... B26B 21/222 30/50
2004/0055159 A1 * 3/2004 Khomari ..... B26B 21/44 30/49
2016/0250766 A1 * 9/2016 Gratsias ..... B26B 21/522 30/526

* cited by examiner

*Primary Examiner* — Phong H Nguyen
(74) *Attorney, Agent, or Firm* — Hudak, Shunk & Farine Co., LPA

(57) ABSTRACT

A preflex, arcuately shaped blade head is formed of a cartridge having a cutting edge supported on a curved, flexible blade support. The blade head is oversized, being greater than 2¼" in lateral linear length. An outrigger blade stabilizer extends posteriorly cantilevered from the blade support. A palm gripping handle forms a bulbous, palm accommodating shaped gripping member having a plan outline shaped generally of kite shape or an elongated Reuleax triangle, with a heel element forming a volar outer ridge at a distal end. An upper arcuate surface forms an oblique arch about the lateral plane of the handle. A longitudinal arch is further formed about the linear plane of the handle. A lower curved surface forms a finger receiving notch at a proximal end of the handle. Such features significantly extend the range of use of the shaver and is specifically adapted for shaving a user's scalp.

8 Claims, 9 Drawing Sheets

CRANIAL SHAVING DEVICE

RELATED APPLICATIONS

The present application claims the benefit of U.S. Ser. No. 62/352,766 filed on Jun. 21, 2016 and incorporated by reference as if fully rewritten herein

BACKGROUND OF THE INVENTION

1. Field of the Invention

The present invention relates to generally to shaving devices and, more particularly, to a shaving device and system adapted for the easy shaving of user's head.

2. Description of the Related Art

The practice of shaving the hair from a person's head has been popular and existed at different times and different places for different reasons. The reason people have shaved, all or part of, their heads are varied. Practical convenience, low maintenance, or religious, cultural, or aesthetic reasons have all occurred. More recently, those men with male pattern baldness have chosen to fully shave their heads for style, aesthetic, or to hide the effects of balding.

For the current (generally) male individual that chooses to adopt such a style, the tools and systems that exist are generally those adapted for other purposes. Clippers, while developed and used to trim hair and especially hair on the head, can easily trim the hair uniformly to a very short length. However, the result is inadequate as a "buzz cut" and is different in result and appearance. The remaining tools include those razors that are adapted for shaving one's face or body.

Because facial razors are designed for the face, an area with more angles and tighter contours, adapting such tools for shaving one's head results in some problems. Gripability of a razor's stick linear handle at the angles necessary to reach the top or back of one's head is awkward. The generally narrow blade cutting head lengthens the task. And, the curve at the top and back of the cranium, along with its rigid structure, makes maintaining blade contact with the skin difficult.

A search of the art found some examples of shaver designs other than the simple "straight handle shavers". These include:

U.S. Patent Application Publication No. US2014/0101947, published in the name of Samuels et al., an adjustably positionable razor assembly is provided having a body, and a handle is movably coupled to a top of the body. An articulating member is movably coupled to a bottom of the body. A head is movably coupled to a bottom of the articulating member. A blade is coupled to the head.

U.S. Patent Application Publication No. US2015/0040405, published in the name of Kulshreshtha, provide an electric hair clipper having a housing containing an electrical source and drive related components. A clipper mechanism having a reciprocating clipper is located beneath the bottom of the housing but is space therefrom by a central hub hat extends downwardly from the bottom of the housing. The housing, central hub and clipper mechanism are arranged such that a person can hold the electric hair clipper by placing his or her fingers in the space between the housing and the clipper mechanism with the central hub lying between two fingers in the space between the housing and the clipper mechanism with the central hub lying between two fingers and with the back of the person's fingers resting in a pair of elongated spaced apart recesses formed I the bottom of the housing on the opposite sides of the hub.

U.S. Pat. No. 6,112,421, issued in the name of Greene, discloses a multi-use razor that is configured for selectively shaving the head or face and Wherein a body member has an upstanding finger engaging means whereby a body member may be retained in relationship to the fingers of the user, and which retains in releasable or integral fashion and in pivotable or nonpivotable relationship a razor blade, and wherein the razor may be selectively used to shave the head of the user or when taken off the finger, may be used to shave the face of the user in conventional fashion.

U.S. Pat. No. 8,782,911, issued in the name of Greene, discloses a versatile shaver having a shaver body with a blade cartridge mounted at one end of the underside and a rotating wheel at the other end. A resilient finger hook and associated pads are located on an upper surface. A user can insert an index finger through the hook and use the shaver in a palm grip to shave the scalp. The shaver body narrows between the blade end and the wheel end thus facilitation a grip between the fingers and thumb for ready shaving of the face.

U.S. Design Pat. No. D667,168, also issued in the name of Greene, discloses an ornamental design for a finger retained razor.

U.S. Design Pat. No. D603,096, also issued in the name of Greene, discloses an ornamental design for a folding shaver.

U.S. Design Pat. No. D500,889, also issued in the name of Greene, discloses another ornamental design for a shaving apparatus.

U.S. Pat. No. 8,984,756, issued in the name of Worrick, discloses a shaving system in which a shaving razor includes a cartridge having a cartridge housing and a handle. The cartridge housing has a front edge, a rear edge and two side edges extending from the front edge to the rear edge. One or more shaving blades are located on the housing and between the front edge and the rear edge. A connecting member is connected to the cartridge housing and includes a deflectable element defining at least a portion of an opening extending through the connecting member. The handle includes a handle interconnect member that includes a protrusion having an enlarged distal end and angled side surfaces extending from the distal end to a base.

U.S. Pat. No. 8,991,060, issued in the name of Safar, discloses a fingertip shaving device in which a fingertip mountable shaving device is provided by a flexible and breathable substrate layer including a first shaving surface, and a second adhesive surface opposite to the first shaving surface. The first shaving surface includes a plurality of rubber strips along the vertical peripheral edge and a plurality of blade assemblies affixed at predetermined locations. The blade assemblies of include a vertical stack of a plurality of rotary blades of different diameters alternately interspaced by spacers and having a hemi-spherical protective cap with a vertical stem, on the top. The second adhesive surface is coated with an adhesive suitable for temporarily mounting the device on a fingertip and is covered with a releasably connected protective peel off layer. The device can safely and closely shave hair from the face and other difficult to reach body surfaces, such as within the ear or nostrils.

Consequently, a need has been felt for providing an apparatus and system for shaving that is specifically adapted for the easy shaving of user's head.

SUMMARY OF THE INVENTION

It is thus an object of the present invention to provide an improved razor device.

It is a feature of the present invention to provide a shaving device and system adapted for the easy shaving of user's head.

The present invention provides a razor system and method adapted for shaving of a user's head comprising a preflex, arcuately shaped blade head formed of a replaceable, disposable cartridge having a cutting edge supported on a curved, flexible blade support; and, an ergonomically designed and shaped palm gripping handle. The said blade head is oversized, being greater than 2¼" in lateral linear length. An outrigger blade stabilizer extends posteriorly cantilevered from the blade support. The extra wide and flexible blade head allows for flexing without stressing the support. The palm gripping handle forms a bulbous, palm accommodating shaped gripping member having a plan outline shaped generally of kite shape or an elongated Reuleax triangle, with a heel element forming a volar outer ridge at a distal end. An upper arcuate surface forms an oblique arch about the lateral plane of the handle. A longitudinal arch is further formed about the linear plane of the handle. A lower curved surface forms a finger receiving notch at a proximal end of the handle. These differences in features significantly extend the range of use of the shaver and is specifically adapted for shaving a user's scalp.

Further features, objects, and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
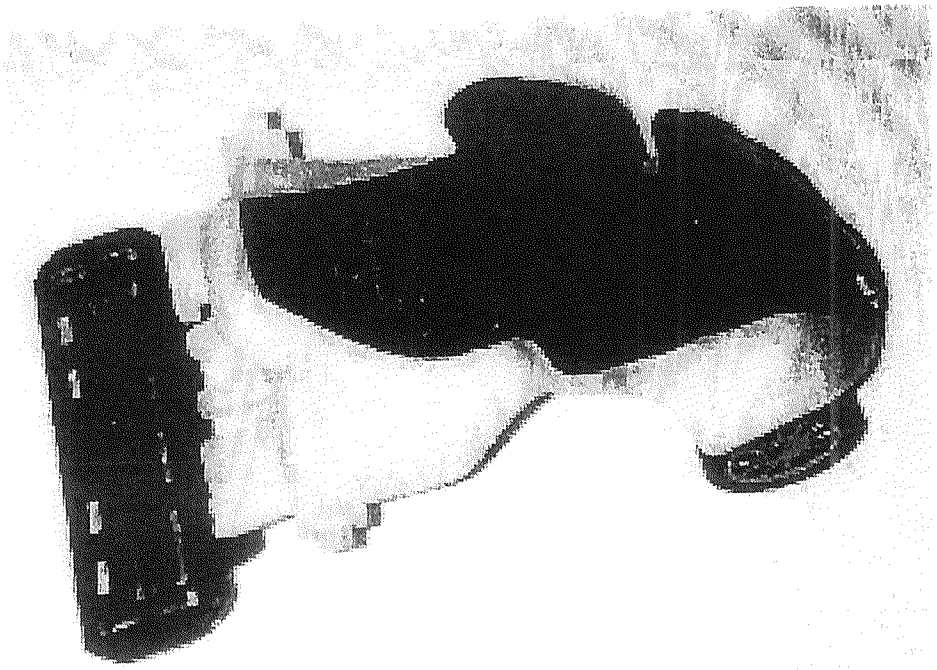
PRIOR ART FIG. 1
FIG. 1 is a perspective view of a cranial shaving device according to the PRIOR ART.
Figure 2:
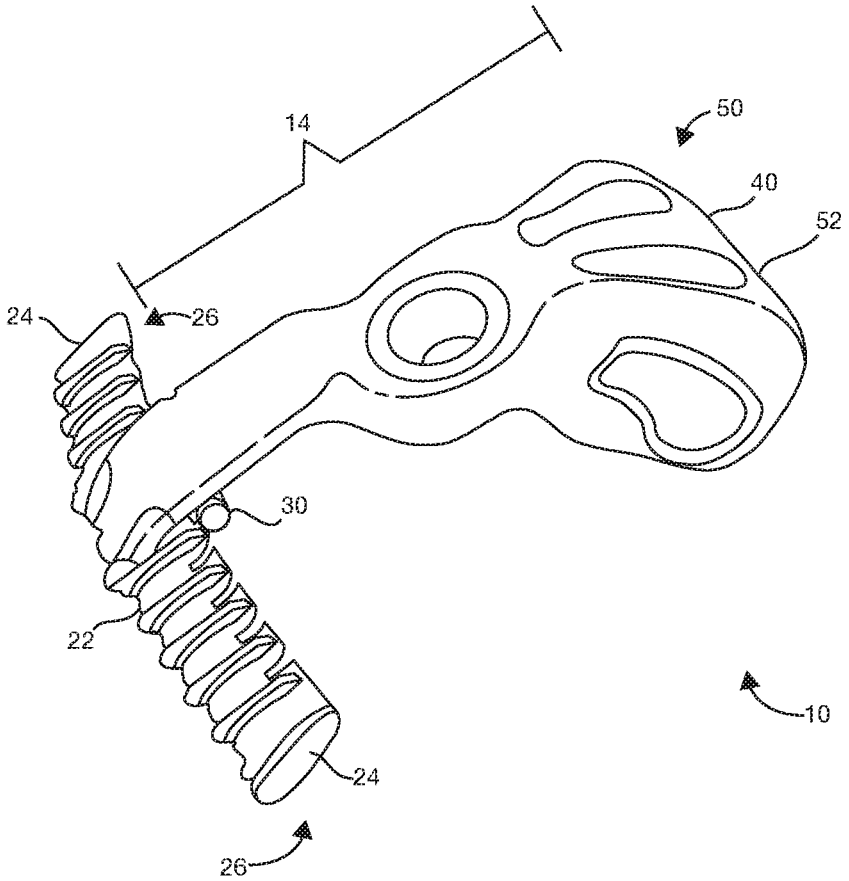
FIG. 2 is a top front perspective view of a cranial shaving device according to a preferred embodiment of the present invention.
Figure 3:
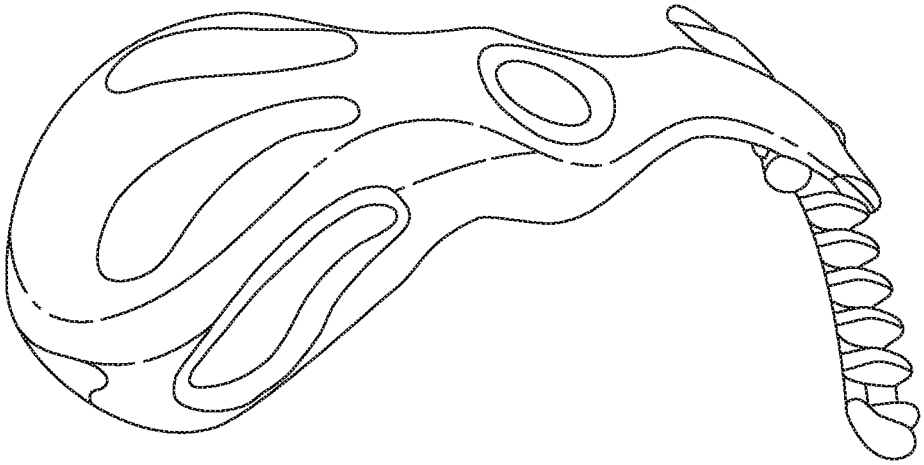
FIG. 3 is a top rear perspective view thereof.

The best mode for carrying out the invention is presented in terms of its preferred embodiment, herein depicted within the Figures. As shown in conjunction with FIG. 1, a razor device adapted for use in shaving the cranium is shown according to the PRIOR ART. While such as device provides for somewhat different positioning and grasping than otherwise conventional safety razors, a conventional blade cartridge is still in use. Shown for purposes of comparison, the present invention, described herein below, utilizes a different handle, a different blade, and a different angle of approach and method of use than anything currently available commercially. However, it should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to lira it the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the FIGS. 2 through 9.

1. Detailed Description of the Figures

Referring now to the drawings, wherein like reference numerals indicate the same parts throughout the several views, an improved shaver apparatus, generally noted as 10, is provided according to a preferred embodiment of the present invention. As shown herein, the shaver 10 is specifically adapted for use in shaving hair from a user's head.

Generally, the shaver 10 includes the improvements of: an oversized, preflex blade head 12; and, an ergonomically designed and shaped palm gripping handle 14.

The blade head 12 is intended to be both oversized and arcuately shaped. A typical safety razor of the type that has developed over more than the last 100+ years has developed a generally standardized form factor, namely, having a lateral length that is generally linear and planar and of between approximately 1½" to approximately 2¼". In contrast, according to one aspect of the present invention the blade head 12 is intended to be greater than 2¼" in lateral linear length "W1". According to another aspect of the present invention, the blade head 12 is approximately 3" in lateral length "W1". According to yet another aspect of the present invention, the blade head 12 is intended to be greater than 3" in lateral length "W1".

The blade head 12 is additional intended to be formed of a replaceable, disposable cartridge in which a cutting edge 20 is supported on a curved, flexible blade support 22. Although one cutting edge 20 is shown by way of example, it should be understood by those having ordinary skill in the relevant art that any number of individual cutting edges 20 may be utilized. The outermost edges 24 of the blade support 22 include lubricated guide tips 26. Further, the blade support 22 includes an outrigger blade stabilizer 30 extending posteriorly cantilevered therefrom. The blade support 22 itself may be segmented, thereby providing the extra wide blade the ability to flex and allow for a smooth blend profile without stressing the head unit.

As will become more apparent in combination with the description of the operation of the invention below, the combination of the curved blade support 22 and outrigger blade stabilizer 30 form a guided shaving/cutting path that is both curved to accommodate the shape of the skull as well as supported and guided to allow for easy stroke implementation in a manner amenable to tactile feedback of operation (rather than visual feedback).

Referring now to the ergonomically designed and shaped palm gripping handle 14, a bulbous, palm accommodating shaped gripping member 40 having a plan outline shaped generally of kite shape or an elongated Reuleax triangle, with a heel element 50 forming a volar outer ridge 52 at a distal end. The upper arcuate surface 42 forms an oblique arch "A1" about a lateral plane, and forms a generally longitudinal arch "A2" about a linear plane. Along a lower curved surface 44 is formed a finger receiving notch 46 at a proximal end 56 of the handle 14.

The proximal end 56 extends or attaches to a neck 60 for support and attachment of the blade head 12. While the specific overall dimensions of the handle 14 may be adapted within a range of various sized depending upon a design choice, according to one aspect of the present invention the handle 14 will have an oversized form factor of generally about over approximately 6" in length "L1", approximately 3" in width "W2" and 2 inches in height "H1". According to another aspect of the present invention, the handle 14 will have an oversized form factor of generally about approximately 6¼" in length "L1". According to yet another aspect of the present invention, the handle 14 will have an oversized form factor of over approximately 6¼" in length "L1".

Further provided are a plurality of cavities formed within the handle 14. Such structures provide improve gripping feel, decrease the weight and increased the handling of the razor 10. A first gripping hole 70 is formed at the proximal end of the handle between the handle and the neck. Positioned generally above the finger notch formed on the underside, the first gripping hole 70 is positioned at a fulcrum point of the overall length, at a position a first distance "L1" from the heel and a second distance "L2" from the proximal end of the razor 10. According to a first aspect of the present invention, the first distance "L1" is generally equal to the second distance "L2". According to another aspect of the present invention, the first distance "L1" is generally less than the second distance "L2".

Figure 4:
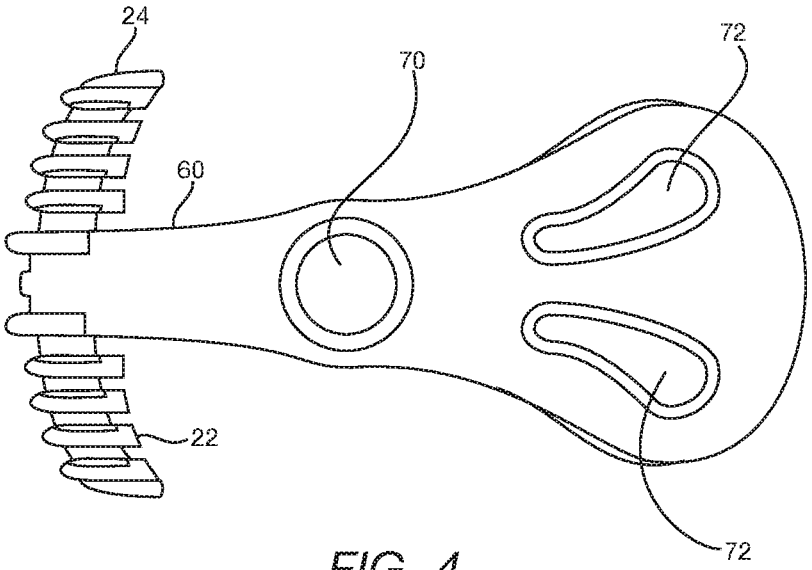
FIG. 4 is a top plan view thereof.
Figure 5:
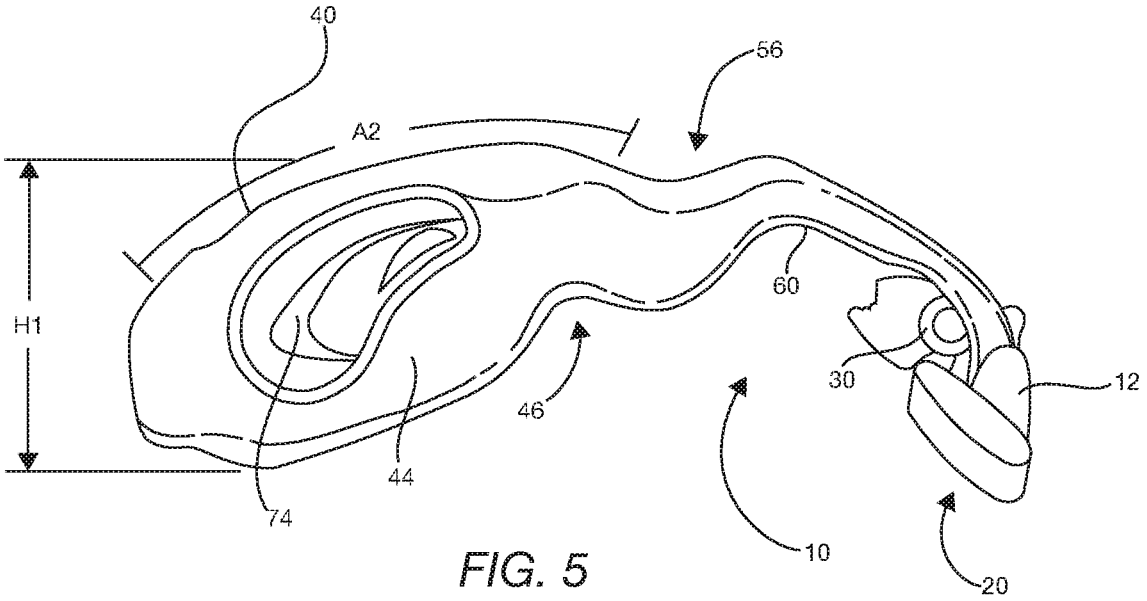
FIG. 5 is a right side elevational view thereof, the left side being a mirror image.
Figure 6:
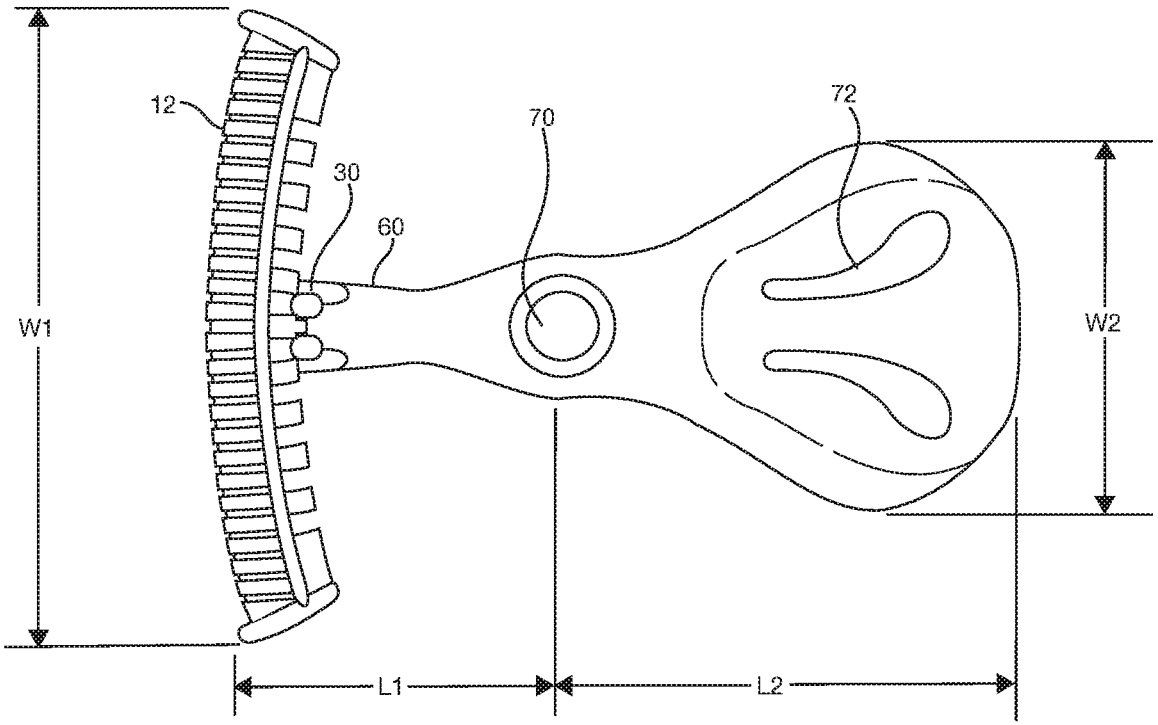
FIG. 6 is a bottom plan view thereof.
Figure 7:
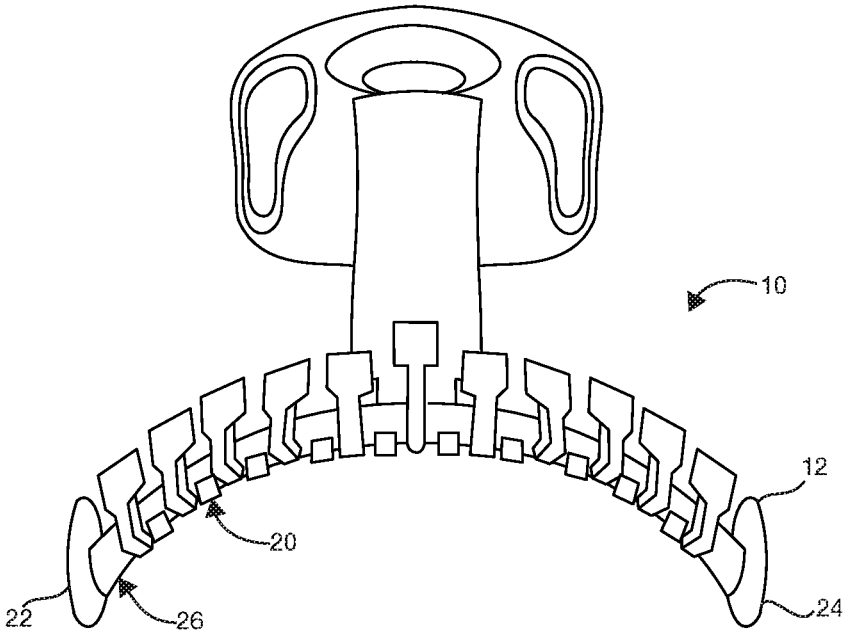
FIG. 7 is a front elevational view thereof.
Figure 8:
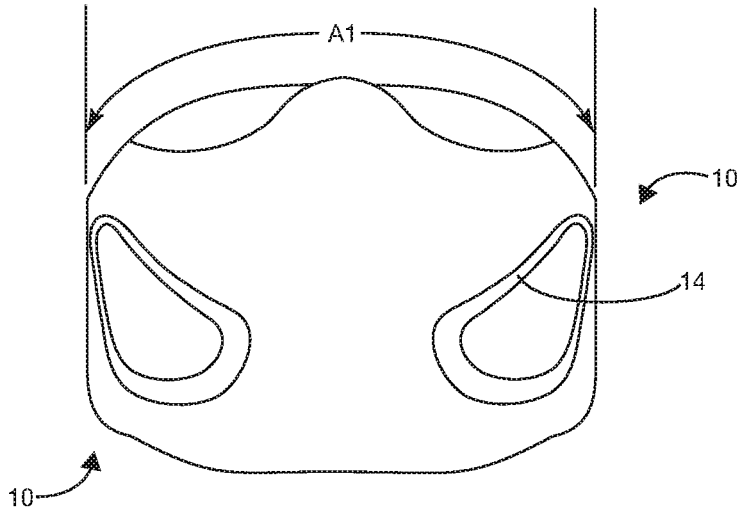
FIG. 8 is a rear elevational view thereof.
Figure 9:
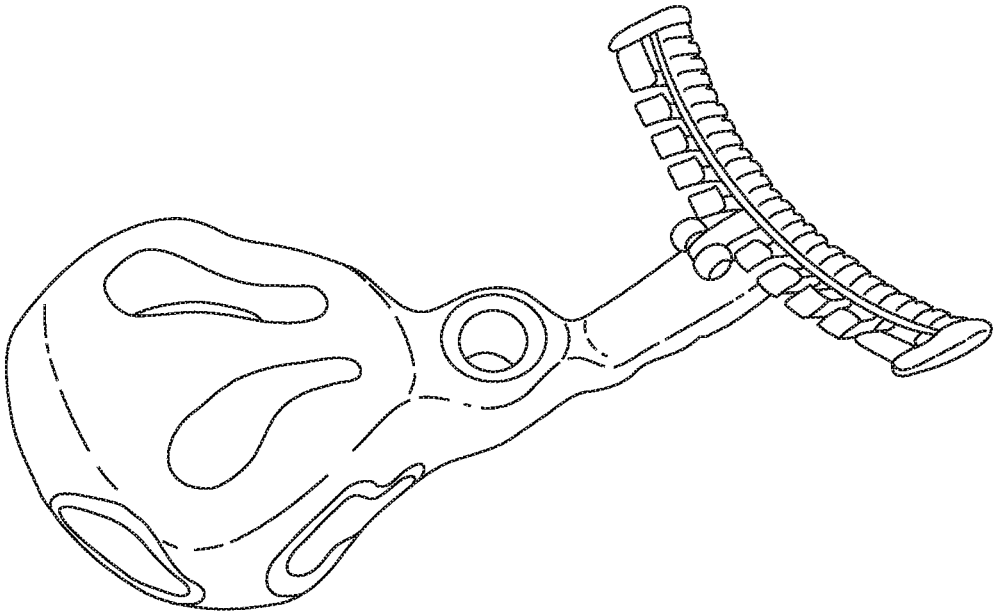
FIG. 9 is a rear bottom perspective view thereof.

Additional gripping cavities 72, 74 are formed along the linear axis of the handle 14 along the top plan (see FIG. 3, FIG. 5) and side elevation (see FIG. 4). Such cavities for gripping orifices that create a grasping structure that is more in line with metacarpal and phalange bones of the user's hand and thereby allowing improved control around the flexing point at the user's wrist.

While variations in the material of construction should include a wide range of equivalents, it is intended in a primary aspect of the present invention that the handle 14 may be formed of a rigid plastic material. And, another aspect of the present invention is to provide elastomeric or resilient over molded pads along a rigid plastic handle to provide surface elements having increased gripping ability.

2. Operation of the Preferred Embodiment

In operation, the present invention is used in a manner similar to the shavers disclosed in the other prior art in that the blade cutting edge is passed along an area of the body that the user wished to shave. However, shaving of the head poses particular problems, including: the angle of operation is unusual and normally uncomfortable; a good portion of the shaving area located such that the user is unable to view in a mirror while shaving; or having the curvature or hardness of the skin over the scalp preventing the blade head from conforming thereto. As would be apparent to one having ordinary skill in the relevant art in light of the present teachings, a user intending to shave his or her head with a razor 10 of the present invention would have a much easier time manipulating the razor 10 through the graspable handle 14 conforming within the curvature of the user's palm. This conformance is maintained whether pulling razor forward, backwards or sideways, and at the top, along the sides or at the rear of the head. The shaver 10 includes a finger hook 46 for grasping by the user's second finger in a prehensile fashion while placing the index finger over the first gripping hole 70. With the balance of the user's digits grasping each side of the handle, manipulation of the shaver, and especially its blade These differences significantly extend the range of use of the shaver and is specifically adapted for shaving a user's scalp.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by following claims.

What is claimed is:

1. A razor system, comprising:

an arcuately shaped blade head comprising a replaceable, disposable cartridge having a curved cutting edge supported by a curved, flexible blade support, wherein said blade head is greater than 2¼" in lateral linear length, and an outrigger blade stabilizer extending posteriorly cantilevered from a mid-section of the blade support, wherein the curved blade support and the outrigger blade stabilizer form a curved guided shaving path to accommodate a shape of a skull, and a palm gripping handle comprising a neck and a gripping member, wherein the cartridge is removably connected to the neck of the handle;

wherein when not in use, portions of each of the cutting edge and blade support extend laterally outwardly and downwardly away from an end of the handle neck to which the cartridge is attached, and wherein the palm gripping handle has an upper arcuate surface about a lateral plane, a longitudinal arch about a linear plane, and a lower curved surface including a notch at a proximal end and adapted to receive a finger, and wherein the palm gripping handle further includes a gripping hole positioned on the longitudinal arch at the proximal end of the palm gripping handle, in front of the notch.

2. The razor system of claim 1, wherein said palm gripping handle forms a bulbous, palm accommodating shaped gripping member having a plan outline of kite shape or an elongated Reuleax triangle, with a heel element forming a volar outer ridge at a distal end.

3. The razor system of claim 2, wherein the upper arcuate surface forms an oblique arch about the lateral plane.

4. The razor system of claim 1, wherein the blade support is segmented to allow the cutting edge to flex.

5. The razor system of claim 1, wherein outermost edges of the blade support include lubricated guide tips.

6. A razor, comprising:

a pre-flexed, flexible, arcuately shaped blade head comprising a cartridge having a curved cutting edge supported on a curved, segmented flexible blade support in a natural state; and an outrigger blade stabilizer extending posteriorly cantilevered from a mid-section of the blade support, wherein the blade support and the outrigger blade stabilizer form a curved guided shaving path to accommodate a shape of a skull, said blade head being greater than 2¼" in lateral linear length; and a palm gripping handle forming a bulbous, palm accommodating shaped gripping member having an upper arcuate surface forming an oblique arch about a lateral plane of the handle and a longitudinal arch further formed about a linear plane of the handle, and a lower curved surface adapted as a finger receiving notch at a proximal end of the handle, wherein the handle has a neck, wherein the cartridge is removably connected to the neck of the handle; and wherein when not in use, portions of each of the cutting edge and blade support extend laterally outwardly and downwardly away from an end of the handle neck, and wherein the palm gripping handle further includes a gripping hole positioned on the longitudinal arch at a proximal end of the palm gripping handle, in front of the notch.

7. The razor of claim 6, wherein said palm gripping handle forms a plan outline of kite shape or an elongated Reuleax triangle and further comprises a heel element forming a volar outer ridge at a distal end.

8. The razor of claim 6, wherein said palm gripping handle further comprises a plan outline of kite shape or an elongated Reuleax triangle.

* * * * *